US008864480B2

(12) United States Patent
Jung et al.

(10) Patent No.: US 8,864,480 B2
(45) Date of Patent: Oct. 21, 2014

(54) OIL RECOVERY MEMBER, AND MOTOR MECHANISM AND COMPRESSOR USING THE SAME

(75) Inventors: Hae-Ok Jung, Busan (KR); Jae-Yeol Lee, Busan (KR); Yong-Beom Yeom, Changwon-si (KR)

(73) Assignee: LG Electronics Inc., Seoul (KR)

( * ) Notice: Subject to any disclaimer, the term of this patent is extended or adjusted under 35 U.S.C. 154(b) by 809 days.

(21) Appl. No.: 13/055,667

(22) PCT Filed: Jul. 27, 2009

(86) PCT No.: PCT/KR2009/004164

§ 371 (c)(1),
(2), (4) Date: Mar. 10, 2011

(87) PCT Pub. No.: WO2010/011115

PCT Pub. Date: Jan. 28, 2010

(65) Prior Publication Data

US 2011/0158840 A1 Jun. 30, 2011

(30) Foreign Application Priority Data

Jul. 25, 2008 (KR) ..... 10-2008-0073175
Jul. 25, 2008 (KR) ..... 10-2008-0073176
Aug. 5, 2008 (KR) ..... 10-2008-0076698

(51) Int. Cl.

| | |
|---|---|
| ***F04C 29/02*** | (2006.01) |
| ***F04B 39/04*** | (2006.01) |
| ***F04C 29/12*** | (2006.01) |
| ***F04C 18/356*** | (2006.01) |
| ***F04C 23/00*** | (2006.01) |
| ***F04B 39/02*** | (2006.01) |
| *F04C 29/04* | (2006.01) |

(52) U.S. Cl.

CPC ..... *F04B 39/0207* (2013.01); *F04B 39/04* (2013.01); *F04C 29/12* (2013.01); *F04C 29/026* (2013.01); *F04C 2240/806* (2013.01); *F04C 18/3564* (2013.01); *F04C 23/008* (2013.01); *F04C 29/045* (2013.01); *Y10S 418/01* (2013.01)

USPC ..... 418/83; 418/100; 418/270; 418/DIG. 1; 417/372; 417/313; 417/366

(58) Field of Classification Search

CPC .... F04C 18/356; F04C 18/3564; F04C 29/02; F04C 29/12; F04C 29/045; F04C 2240/806; F04B 39/0207; F04B 39/04

USPC ..... 418/83, 100, 270, DIG. 1; 417/372, 313, 417/366, 368

See application file for complete search history.

(56) References Cited

U.S. PATENT DOCUMENTS 2,113,691 A 4/1938 Heller ..... 230/58
4,762,471 A * 8/1988 Asanuma et al. ..... 418/DIG. 1

(Continued)

FOREIGN PATENT DOCUMENTS

FR 1126277 11/1956
JP 62-057787 4/1987

(Continued)

OTHER PUBLICATIONS

European Search Report dated Nov. 4, 2011.

(Continued)

*Primary Examiner* — Mary A Davis
(74) *Attorney, Agent, or Firm* — Ked & Associates, LLP

(57) ABSTRACT

An oil recovery member, a motor mechanism, and a compressor using the same are provided. The oil recovery member is provided to prevent oil rising along a rotational shaft from being discharged with refrigerant, and relative sizes, such as installation positions between the oil recovery member and components adjacent thereto, are restricted. As the oil flow is guided through a passage defined between the oil recovery member and the adjacent components, the oil may be efficiently recovered, so that, an oil circulation rate of a freezing cycle may be reduced and compression efficiency improved.

23 Claims, 9 Drawing Sheets

(56) References Cited

U.S. PATENT DOCUMENTS

| | | | | |
|---|---|---|---|---|
| 5,087,170 | A * | 2/1992 | Kousokabe et al. | 417/366 |
| 5,464,332 | A * | 11/1995 | Beck et al. | 417/368 |
| 6,147,428 | A * | 11/2000 | Takezawa et al. | 310/156.57 |
| 6,533,558 | B1 * | 3/2003 | Matsumoto et al. | 417/368 |
| 6,623,253 | B1 * | 9/2003 | Onoda et al. | 417/366 |
| 8,337,185 | B2 * | 12/2012 | Tanaka | 418/270 |

FOREIGN PATENT DOCUMENTS

| | | | |
|---|---|---|---|
| JP | 08-065961 | | 3/1996 |
| JP | 08-177738 | | 7/1996 |
| JP | 11-118272 | | 4/1999 |
| JP | 2005-201171 | | 7/2005 |
| JP | 2007255214 | A * | 10/2007 |
| KR | 10-1996-0023817 | | 7/1996 |
| KR | 10-2005-0062995 | | 6/2005 |
| KR | 10-2007-0009958 | | 1/2007 |

OTHER PUBLICATIONS

PCT International Search Report and Written Opinion dated Oct. 28, 2009 issued in Application No. PCT/KR2009/004164.

* cited by examiner

OIL RECOVERY MEMBER, AND MOTOR MECHANISM AND COMPRESSOR USING THE SAME

TECHNICAL FIELD

The present invention relates to an oil recovery member, wherein installation positions and sizes of the oil recovery member and another member adjacent thereto are restricted to define a passage for efficiently recovering oil, although the oil rises with rotation of a rotation shaft, and a motor mechanism and a compressor using the same.

BACKGROUND ART

In general, a compressor is a mechanical apparatus receiving power from a power generation apparatus such as an electric motor, a turbine or the like, and compressing the air, refrigerant or various operation gases to raise a pressure. The compressor has been widely used for electric home appliances such as refrigerators and air conditioners, and application thereof has been expanded to the whole industry.

The compressors are roughly classified into a reciprocating compressor, wherein a compression space to/from which an operation gas is sucked and discharged is defined between a piston and a cylinder, and the piston linearly reciprocates in the cylinder to compress refrigerant, a rotary compressor, wherein a compression space to/from which an operation gas is sucked and discharged is defined between an eccentrically-rotating roller and a cylinder, and the roller eccentrically rotates along an inside wall of the cylinder to compress refrigerant, and a scroll compressor, wherein a compression space to/from which an operation gas is sucked and discharged is defined between an orbiting scroll and a fixed scroll, and the orbiting scroll rotates along the fixed scroll to compress refrigerant.

Korean Laid-Open Patent Publication No. 10-1996-0023817 discloses a rotary compressor, wherein a cylinder and a motor are stacked in an axial direction, so that refrigerant is compressed in the cylinder compressing a defined capacity. If a constant speed type motor is used as the motor, since the motor has a uniform rotational speed, it can regulate a compression capacity per hour to be uniform. However, if an inverter type motor is used as the motor, since the motor has a variable rotational speed, it can vary a compression capacity per hour.

Korean Laid-Open Patent Publication No. 10-2005-0062995 discloses a rotary type twin compressor, wherein two cylinders and a motor are stacked in an axial direction, so that refrigerant is simultaneously compressed in the two cylinders compressing the same capacity. As compared with a general compressor, this compressor doubles a compression capacity.

Korean Laid-Open Patent Publication No. 10-2007-0009958 discloses a rotary type two-stage compressor, wherein two cylinders and a motor are stacked in an axial direction, and a special passage is provided to connect the two cylinders, so that refrigerant compressed in one cylinder is compressed in the other cylinder. As compared with a general compressor, this compressor doubles a compression degree.

The rotary compressor is used in a freezing cycle. When the rotary compressor operates, oil is circulated to cool/lubricate inside components thereof. Here, some of the liquid-phase oil is discharged from the rotary compressor with gas-phase refrigerant. However, if the oil is excessively discharged from the rotary compressor to the freezing cycle, the components inside the rotary compressor are abraded/overheated due to lack of the oil, which reduces operation reliability. Otherwise, since the oil flows along the freezing cycle and lays on a passage due to a fall of a temperature and pressure, the oil is difficult to recover. Therefore, the rotary compressor adopts various oil recovery structures to prevent the oil from being discharged through the freezing cycle with high pressure refrigerant.

Meanwhile, the rotary compressor includes a compression mechanism unit and a motor unit driving the same. Motors are classified into a distributed winding type and a concentrated winding type according to winding methods.

In the distributed winding type, respective phase windings are wound around a few slots in a distributed manner. As a plurality of coil groups lay on the slots, a coil end increases in an axial direction of the winding, so that a space factor of the winding inserted into the slot is not high. Accordingly, in the rotary compressor using the distributed winding motor, since relatively many empty spaces are formed in the motor due to a not-high winding space factor, although oil is pumped, it can be recovered through the distributed winding motor. Although the rotary compressor does not adopt a special oil recovery hole or oil recovery structure, there is no difficulty.

In the concentrated winding type, windings are wound around one slot in a concentrated manner. A concentrated winding slot has a smaller area and more poles than a distributed winding slot. A coil is directly wound around the pole in a direct winding type, or inserted into an inside diameter slot opening groove of a stator in an insert winding type. As compared with the distributed winding type, a coil end decreases in an axial direction of the winding and a winding space factor increases. Therefore, in the rotary compressor using the concentrated winding motor, since relatively few empty spaces for use in recovering oil are formed in the motor due to a high winding space factor, although the oil is pumped, it cannot be easily recovered through the concentrated winding motor. Preferably, the rotary compressor adopts an oil recovery hole or oil recovery structure to easily recover the oil.

FIG. 1 is a vertical-sectional view illustrating an overall structure of a rotary compressor which is one example of the prior art, and FIG. 2 is an exploded view illustrating an attachment structure of an oil separation member applied to FIG. 1.

Japanese Patent Application No. 94-317020 discloses a rotary compressor and an oil recovery structure. As illustrated in FIGS. 1 and 2, a motor unit 11 and a compression unit 12 are provided in a hermetic casing 10, the motor unit 11 is composed of a stator 13, a rotor 14 and a rotation shaft 15, and an oil separation member 50 is mounted at a top end center of the rotor 14. Accordingly, when power is supplied, the rotation shaft 15 rotates due to a mutual electromagnetic force of the stator 13 and the rotor 14, so that refrigerant is compressed in the compression unit 12, filled in the hermetic casing 10, and discharged to the outside. In addition, oil stored in a bottom surface of the hermetic casing 10 rises along the rotation shaft 15. The oil flows through a central portion of the rotor 14, runs against the oil separation member 50 rotating with the rotor 14, is guided to a radius direction, and is recovered to the bottom surface of the hermetic casing 10 through a plurality of holes 54 bored through the periphery of the central portion of the rotor 14 in an axial direction as well as a gap between the stator 13 and the rotor 14.

However, in the conventional rotary compressor, although the oil is pumped, since the oil runs against the oil separation member, it is recovered through the holes of the rotor which are limited spaces and the gap between the stator and the rotor. In the case of the inverter type compressor, although the oil is excessively pumped due to velocity variations, only some of the oil is recovered through the limited spaces, so that an oil recovery rate to the rotary compressor is reduced. Since the oil discharged from the rotary compressor flows through the freezing cycle adopting the rotary compressor and lays on piping, it is difficult to recover the oil to the rotary compressor. As a result, components in the rotary compressor may be abraded, which degrades operation reliability.

FIG. 3 is a graph analyzing oil flowing paths of a conventional rotary compressor. The rotary compressor shown in FIG. 3 is identical to the rotary compressor shown in FIG. 1 except that the oil separation member is omitted. When the rotary compressor operates to compress refrigerant, oil rises through a main passage portion A around a rotation shaft with the refrigerant, runs against a hermetic casing, and is recovered through a recovery passage portion B around the main passage portion A. Here, the recovery passage portion B is composed of first recovery passages B1 which are a plurality of holes bored through the periphery of a central portion of a rotor in an axial direction as described above, a second recovery passage B2 which is a gap between a stator and the rotor, and a third recovery passage B3 which is a space between the hermetic casing and the stator. The passages capable of recovering the oil are widened. Surely, although the oil vertically rising through the main passage portion A runs against the hermetic casing, a comparatively large amount of oil is recovered through the first and second recovery passages B1 and B2 relatively adjacent to the main passage portion A, but a comparatively small amount of oil is recovered through the third recovery passage B3 relatively distant from the main passage portion A.

In the rotary compressor, since the recovery passage portion is smaller than the main passage portion, the oil recovery rate decreases. While the velocity of the oil pumped through the main passage portion is fast (about 10 m/s), the velocity of the oil recovered through the recovery passage of the recovery passage portion positioned at the outermost portion is slow (about 0.005 m/s). Therefore, a large amount of oil stays in an upper portion of the hermetic casing, and is easily discharged to the outside of the hermetic casing with high temperature high pressure refrigerant. Moreover, since the oil recovery rate decreases, as mentioned above, operation reliability is degraded due to friction/abrasion of components.

DISCLOSURE

Technical Problem

The present invention is conceived to solve the foregoing problems in the prior art, and an object of the present invention is to provide an oil recovery member which can improve an oil recovery rate by increasing an oil recovery velocity to be proportional to an oil pumping velocity, using a centrifugal force of a rotor, and a motor mechanism and a compressor using the same.

Another object of the present invention is to provide an oil recovery member which can forcibly guide an oil flow to a radius direction although oil is pumped in an axial direction, and rapidly recover the oil from the outermost portion of the radius direction, and a motor mechanism and a compressor using the same.

Technical Solution

According to an aspect of the present invention for achieving the above objects, there is provided an oil recovery member, including: a barrel-shaped main body with a diameter increasing from a lower portion to an upper portion in an axial direction; and a guide portion extended from a top end of the main body in a radius direction, wherein a ratio of a diameter (a) of the guide portion to a diameter (b) of the lower portion of the main body is maintained to be equal to or larger than 2.85 ($a/b \geq 2.85$).

In addition, the ratio of the diameter (a) of the guide portion to the diameter (b) of the lower portion of the main body is maintained to be equal to or smaller than 3.15 ($a/b \leq 3.15$).

Moreover, a value ($a/b+Lo$) obtained by adding an axial direction height (Lo) to the ratio ($a/b$) is maintained to be equal to or larger than 35.85 ($a/b+Lo \geq 35.85$).

Further, the value ($a/b+Lo$) obtained by adding the axial direction height (Lo) to the ratio ($a/b$) is maintained to be equal to or smaller than 47.5 ($a/b+Lo \leq 47.5$).

According to another aspect of the present invention, there is provided a motor mechanism, including: a rotation shaft with a bottom end soaked in oil; a rotor engaged with an outer circumferential surface of the rotation shaft; a stator installed maintaining a gap from an outer circumferential surface of the rotor, and provided with a coil end at an upper portion when a coil is wound around a core; and an oil recovery member which is coupled to a center of the rotor, and has an axial direction height (Lo) higher than an axial direction height (Lc) of the coil end so as to guide the oil rising with rotation of the rotation shaft to a radius direction.

In addition, a ratio ($d2/d1$) of a top end diameter (d2) of the oil recovery member to an inside diameter (d1) of the coil end is maintained to be equal to or larger than 0.63 so as to improve an oil recovery rate.

Moreover, the ratio ($d2/d1$) of the top end diameter (d2) of the oil recovery member to the inside diameter (d1) of the coil end is maintained to be equal to or smaller than 1.19 so as to reduce a package resistance.

Further, the oil recovery member includes a barrel-shaped main body with a diameter increasing from a lower portion to an upper portion in an axial direction, and a guide portion extended from a top end of the main body in a radius direction, a top end diameter (d2) of the oil recovery member being a diameter of the guide portion.

Furthermore, a ratio of a top end diameter (a) of the oil recovery member to a bottom end diameter (b) of the oil recovery member is maintained to be equal to or larger than 2.85 so as to improve an oil recovery rate ($a/b \geq 2.85$).

Still furthermore, the ratio of the top end diameter (a) of the oil recovery member to the bottom end diameter (b) of the oil recovery member is maintained to be equal to or smaller than 3.15 so as to reduce a passage resistance ($a/b \leq 3.15$).

Still furthermore, a value ($a/b+Lo$) obtained by adding an axial direction height (Lo) of the oil recovery member to the ratio ($a/b$) is maintained to be equal to or larger than 35.85 ($a/b+Lo \geq 35.85$).

Still furthermore, the value ($a/b+Lo$) obtained by adding the axial direction height (Lo) of the oil recovery member to the ratio ($a/b$) is maintained to be equal to or smaller than 47.5 ($a/b+Lo \leq 47.5$).

Still furthermore, the oil recovery member includes a barrel-shaped main body with a diameter increasing from a lower portion to an upper portion in an axial direction, and a guide portion extended from a top end of the main body in a radius direction, a top end diameter (a) of the oil recovery member being a diameter of the guide portion, a bottom end diameter (b) of the oil recovery member being a diameter of the lower portion of the main body.

According to a further aspect of the present invention, there is provided a compressor, including: a hermetic container to/from which refrigerant is sucked and discharged, oil being stored in a bottom surface of which; a compression mechanism unit which is fixed to an inside lower portion of the hermetic container, and compresses the refrigerant; a motor mechanism unit which is fixed to an inside upper portion of the hermetic container, and supplies power to the compression mechanism unit; and an oil recovery member which is coupled to a center of the motor mechanism unit, and guides, to a radius direction, the oil rising along the motor mechanism unit with operation of the motor mechanism unit, wherein a top end of the oil recovery member is installed higher than a top end of the motor mechanism unit in an axial direction.

In addition, the motor mechanism unit includes a rotation shaft, a rotor, and a stator provided with a coil end at an upper portion when a coil is wound around a core, and the oil recovery member is coupled to a center of the rotor so that an axial direction height (Lo) of the oil recovery member can be maintained to be equal to or higher than an axial direction height (Lc) of the coil end (Lo≥Lc).

Moreover, the motor mechanism unit includes a rotation shaft, a rotor, and a stator provided with a coil end at an upper portion when a coil is wound around a core, and an axial direction height (Lo) of the oil recovery member is equal to or smaller than a value obtained by adding an axial direction height (f) of an electric wire withdrawal space to an axial direction height (Lc) of the coil end (Lo≤Lc+f).

Further, the electric wire withdrawal space is a minimum space required to withdraw an electric wire from the coil end to the hermetic container.

Furthermore, the compressor further includes a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 3%.

Still furthermore, the oil recovery holes include one or more of a plurality of first oil recovery holes provided between the hermetic container and the stator, a second oil recovery hole which is a gap between the rotor and the stator, and a plurality of third oil recovery holes provided in the rotor.

Still furthermore, the motor mechanism unit includes a rotation shaft connected to the compression mechanism unit, a cylindrical rotor engaged with an outer circumferential surface of the rotation shaft, and a cylindrical stator fixed to the hermetic container maintaining a gap from an outer circumferential surface of the rotor, and provided with a coil end at an upper portion when a coil is wound around a core, wherein a ratio (d2/d1) of a top end diameter (d2) of the oil recovery member to an inside diameter (d1) of the coil end is maintained to be equal to or larger than 0.63 so as to improve an oil recovery rate.

Still furthermore, the ratio (d2/d1) of the top end diameter (d2) of the oil recovery member to the inside diameter (d1) of the coil end is maintained to be equal to or smaller than 1.19 so as to reduce a passage resistance.

Still furthermore, the oil recovery member includes a barrel-shaped main body with a diameter increasing from a lower portion to an upper portion in an axial direction, and a guide portion extended from a top end of the main body in a radius direction, a top end diameter (d2) of the oil recovery member being a diameter of the guide portion.

Still furthermore, the compressor further includes a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 2.09%. Still furthermore, the oil recovery holes include one or more of a plurality of first oil recovery holes provided between the hermetic container and the stator, a second oil recovery hole which is a gap between the rotor and the stator, and a plurality of third oil recovery holes provided in the rotor.

Still furthermore, a ratio of a top end diameter (a) of the oil recovery member to a bottom end diameter (b) of the oil recovery member is maintained to be equal to or larger than 2.85 so as to improve an oil recovery rate (a/b≥2.85).

Still furthermore, the ratio of the top end diameter (a) of the oil recovery member to the bottom end diameter (b) of the oil recovery member is maintained to be equal to or smaller than 3.15 so as to reduce a passage resistance so as to reduce a passage resistance (a/b≤3.15).

Still furthermore, a value (a/b+Lo) obtained by adding an axial direction height (Lo) of the oil recovery member to the ratio (a/b) is maintained to be equal to or larger than 35.85 (a/b+Lo≥35.85).

Still furthermore, the value (a/b+Lo) obtained by adding the axial direction height (Lo) of the oil recovery member to the ratio (a/b) is maintained to be equal to or smaller than 47.5 (a/b+Lo≤47.5).

Still furthermore, the oil recovery member includes a barrel-shaped main body with a diameter increasing from a lower portion to an upper portion in an axial direction, and a guide portion extended from a top end of the main body in a radius direction, a top end diameter (a) of the oil recovery member being a diameter of the guide portion, a bottom end diameter (b) of the oil recovery member being a diameter of the lower portion of the main body.

Still furthermore, the compressor further includes a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 3%.

Still furthermore, the motor mechanism unit includes a stator fixed to an inside surface of the hermetic container, and a rotor rotatably installed inside the stator, and the oil recovery holes include one or more of a plurality of first oil recovery holes provided between the hermetic container and the stator, a second oil recovery hole which is a gap between the rotor and the stator, and a plurality of third oil recovery holes provided in the rotor.

Advantageous Effects

According to the present invention, in the oil recovery member so constructed, and the motor mechanism and the compressor using the same, since the installation positions and sizes between the oil recovery member and the stator adjacent thereto are restricted, although the oil is pumped along the rotation shaft and the rotor and mixed with the refrigerant filled in the hermetic container, the oil runs against the oil recovery member and is guided to a radius direction by a centrifugal force. Thus, the oil can be easily separated from the refrigerant and prevented from being discharged with the refrigerant. In addition, according to the present invention, the oil recovery holes of the rotor, the oil recovery hole which is a gap between the rotor and the stator, and the supplementary oil recovery holes between the stator and the hermetic container are provided, so that the oil is guided by the oil recovery member and recovered through various oil recovery holes. Therefore, although the compressor operates at a high speed, the oil can be rapidly recovered and circulated again.

Moreover, according to the present invention, although the oil is pumped with the operation of the compressor, the oil runs against the oil recovery member, is guided to a radius direction, and is recovered through the oil recovery holes between the stator and the hermetic container positioned at the outermost portion of the radius direction. Accordingly, it is possible to prevent the components from being abraded/damaged due to lack of the oil in the compressor, and improve operation reliability of the compressor.

MODE FOR INVENTION

Hereinafter, embodiments of the present invention will be described in detail with reference to the accompanying drawings.

Figure 1:
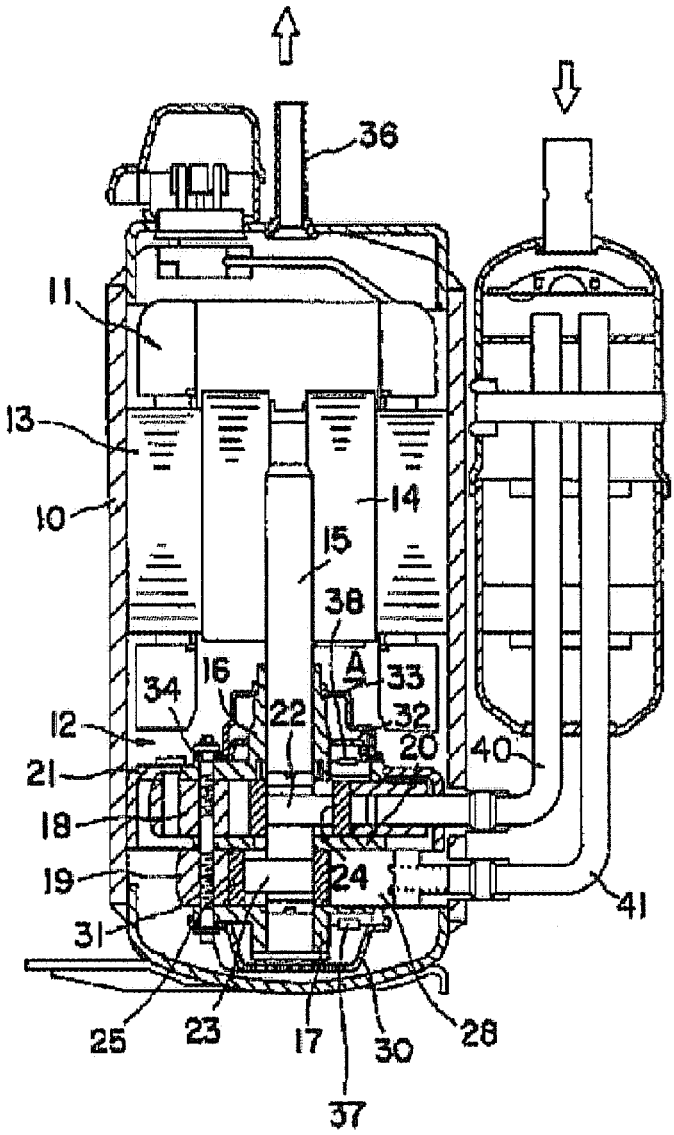
Figure 1 Conventional Art
FIG. 1 is a vertical-sectional view illustrating an overall structure of a rotary compressor which is one example of the prior art.
Figure 2:
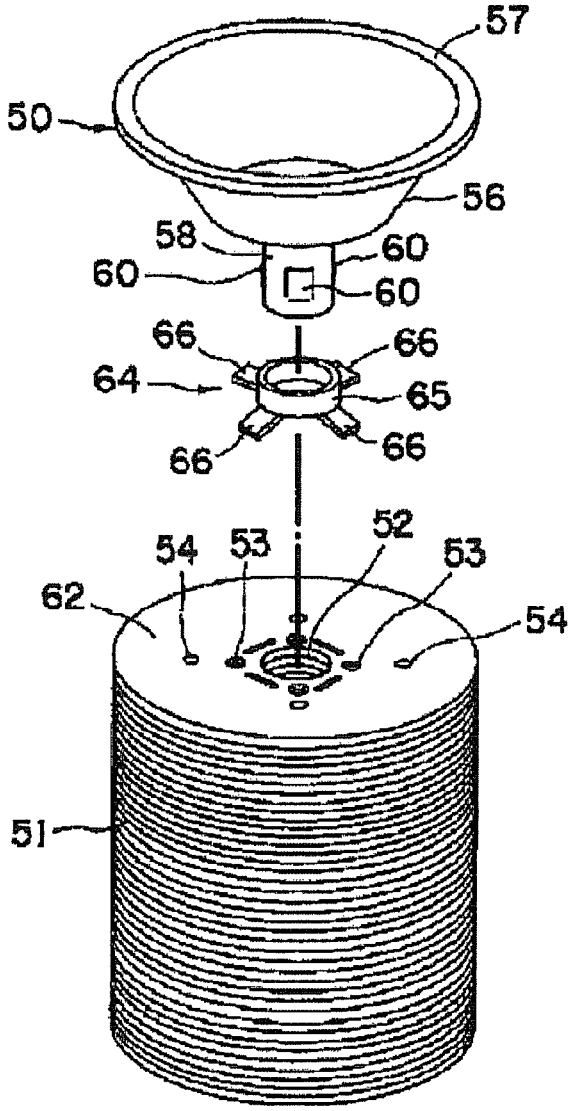
Figure 2 Conventional Art
FIG. 2 is an exploded view illustrating an attachment structure of an oil separation member applied to FIG. 1.
Figure 3:
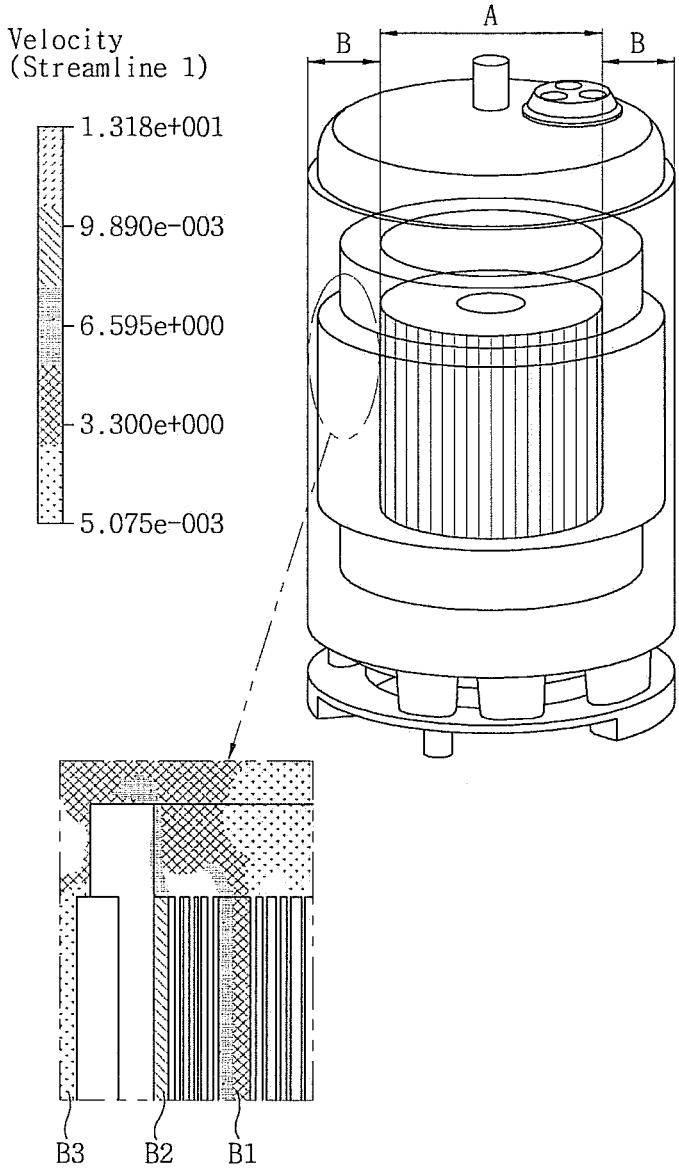
Figure 3 Conventional Art
FIG. 3 is a graph analyzing oil flowing paths of the conventional rotary compressor.
Figure 4:
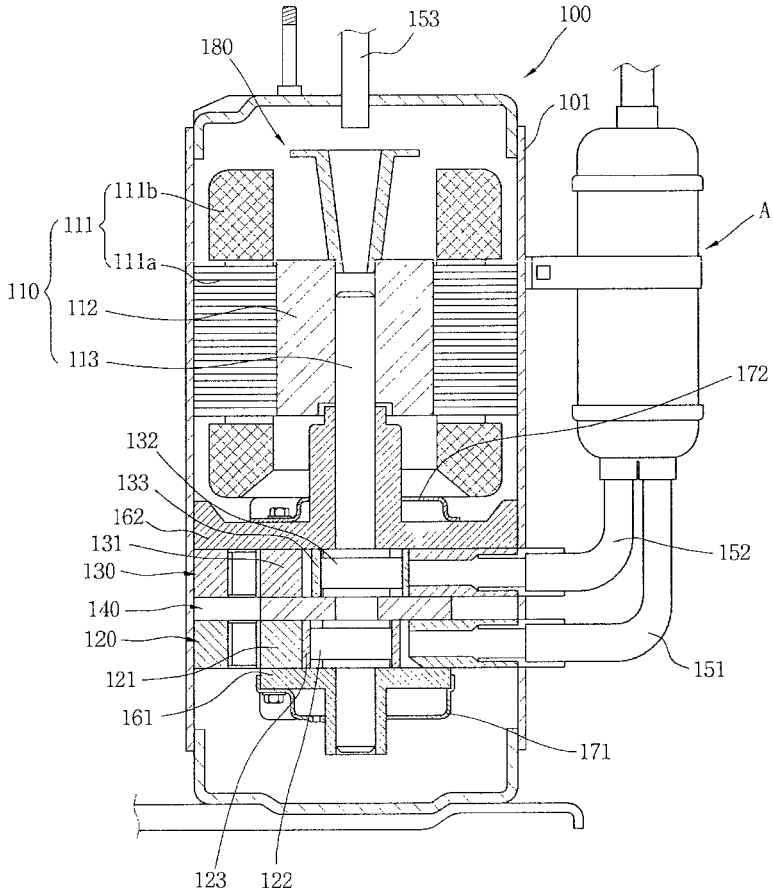
FIG. 4 is a vertical-sectional view illustrating an overall structure of a rotary compressor according to an embodiment of the present invention.

FIG. 4 is a vertical-sectional view illustrating an overall structure of a rotary compressor according to an embodiment of the present invention.

The embodiment of the rotary compressor according to the present invention is a rotary type twin compressor 100. As illustrated in FIG. 4, a motor mechanism unit (not shown) and a compression mechanism unit (not shown) are provided at upper and lower portions of a hermetic container 101, the motor mechanism unit is a motor 110 producing a rotational force, and the compression mechanism unit includes a first compression assembly 120 which compresses some of sucked refrigerant, a second compression assembly 130 which compresses the remaining sucked refrigerant, a middle plate 140 which separates the first and second compression assemblies 120 and 130, a first bearing 161 and a cover 171 which define a first discharge space communicating with the lower side of the first compression assembly 120, and a second bearing 162 and a cover 172 which define a second discharge space communicating with the upper side of the second compression assembly 130. Surely, the rotary type twin compressor 100 constitutes a portion of a freezing cycle including a condenser, a capillary tube or electronic expansion valve and an evaporator, such as a refrigerator or an air conditioner. After gas-liquid refrigerants are separated in an accumulator A, only the gas refrigerant is introduced into the rotary type twin compressor 100.

The hermetic container 101 is a space filled with high pressure refrigerant. First and second inlet tubes 151 and 152 which make the refrigerant sucked into the first and second compression assemblies 120 and 130 are installed penetrating through a side surface of the hermetic container 101, and an outlet tube 153 which discharges the high pressure refrigerant is installed on a top surface of the hermetic container 101.

The motor 110 includes a stator 111, a rotor 112 and a rotation shaft 113. In the stator 111, a coil is wound around a core 111*a* formed by stacking annular electronic steel sheets. The embodiment of the present invention adopts a structure which does not have many empty spaces because the coil is wound in an insert type among concentrated winding methods. A coil end 111*b* is provided at upper and lower portions of the core 111*a*, and the stator 111 is fixed to the inside of the hermetic container 101. The rotor 112 is also formed by stacking electronic steel sheets, and installed inside the stator 111, maintaining a gap therefrom. The rotation shaft 113 penetrates through a center of the rotor 112 and is fixed to the rotor 112. When a current is applied to the motor 110, the rotor 112 rotates due to a mutual electromagnetic force between the stator 111 and the rotor 112, and the rotation shaft 113 fixed to the rotor 112 also rotates with the rotor 112. The rotation shaft 113 is extended from the rotor 112 to the first compression assembly 120, penetrating through the central portions of the first compression assembly 120, the middle plate 140 and the second compression assembly 130.

The first compression assembly 120 and the second compression assembly 130 may be stacked with the middle plate 140 therebetween in the order of the first compression assembly 120, the middle plate 140 and the second compression assembly 130 from the bottom, or in the order of the second compression assembly 130, the middle plate 140 and the first compression assembly 120 from the bottom. In addition, regardless of the stacked order of the first compression assembly 120, the middle plate 140 and the second compression assembly 130, the first bearing 161 and the second bearing 162 are installed at lower and upper portions of the compression assemblies 120 and 130, respectively, to assist rotation of the rotation shaft 113 and support loads of the respective components of the vertically-stacked two-stage compression assemblies 120 and 130. The second bearing 162 installed on the upper side is three-spot welded to the hermetic container 101 to support loads of the two-stage compression assemblies 120 and 130 and fix them to the hermetic container 101.

The first discharge space in which the refrigerant compressed in the first compression assembly 120 is temporarily stored is defined on the lower side of the first compression assembly 120 by the first bearing 161 and the cover 171, the second discharge space in which the refrigerant compressed in the second compression assembly 130 is temporarily stored is defined on the upper side of the second compression assembly 130 by the second bearing 162 and the cover 172, and the first and second discharge spaces serve as buffering spaces on a refrigerant passage. Surely, a discharge port (not shown) and a discharge valve (not shown) may be provided at the first and second bearings 162 and 163, respectively, and a hole communicating with the inside of the hermetic container 101 may be provided in the covers 171 and 172, so that the compressed refrigerant can be sucked and discharged to/from the first and second discharge spaces.

Figure 5:
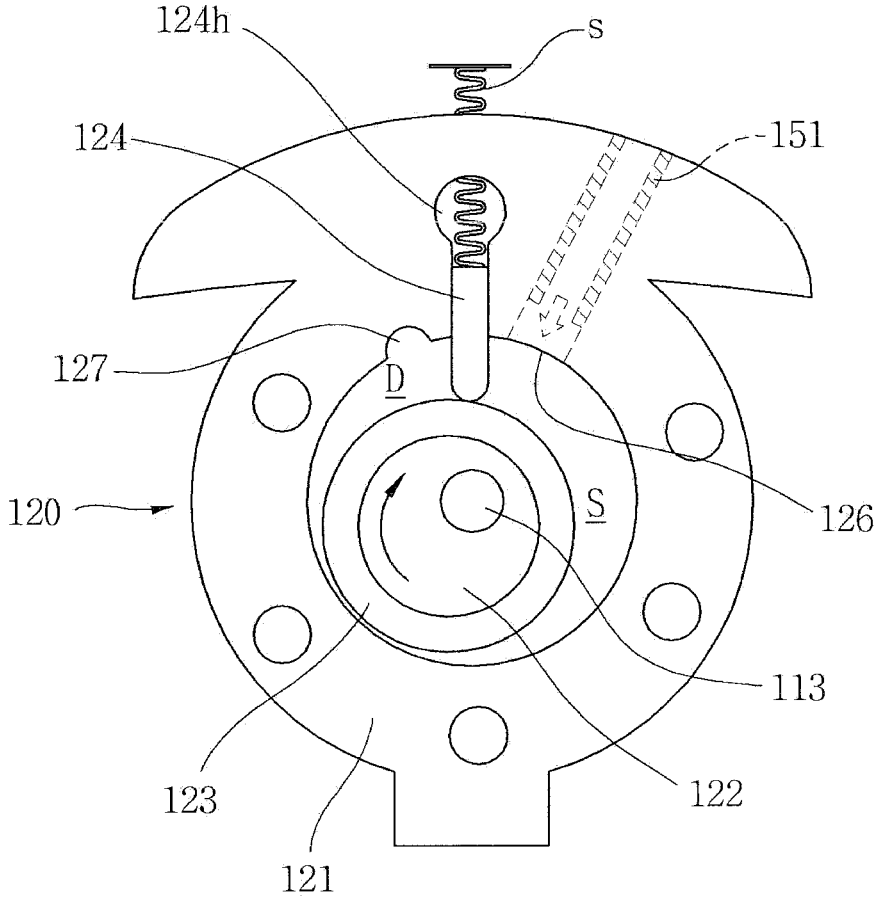
FIG. 5 is a view illustrating one example of a first compression assembly of a rotary type twin compressor according to the present invention, when seen from the bottom.

FIG. 5 is a view illustrating one example of the first compression assembly of the rotary type twin compressor according to the present invention, when seen from the bottom. As illustrated in FIG. 5, the first compression assembly 120 includes a first cylinder 121, a first eccentric portion 122, a first roller 123 and a first vane 124. A vane mounting hole 124*h* on which a first vane portion 122 is elastically supported by an elastic member s is provided in an inside diameter of the first cylinder 121, a suction hole 126 to which the first inlet tube 151 penetrating through the hermetic container 101 is connected is provided on one side of the vane mounting hole 124*h*, and a discharge hole 127 communicating with the first discharge space is provided on the other side of the vane mounting hole 124*h*. That is, the inside space of the first cylinder 121 is divided into a suction region S and a discharge region D by the first roller 123 and the first vane 124, and the refrigerants before and after compression coexist in the first cylinder 121. Accordingly, when the first eccentric portion 122 rotates with the rotation shaft 113, the first roller 123 rolls along the inside of the first cylinder 121, the space between the first cylinder 121 and the first roller 123 is divided into the suction region S and the discharge region D by the first vane 124, and the refrigerant sucked into the suction region S through the first inlet tube 151 and the suction hole 126 is compressed in the discharge region D and discharged through the discharge hole 127 and the first discharge space.

Figure 6:
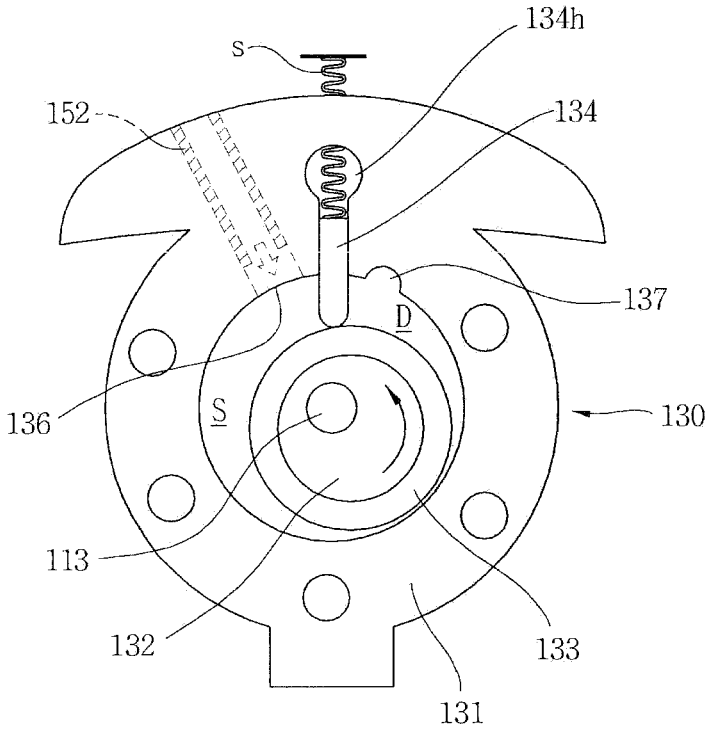
FIG. 6 is a view illustrating one example of a second compression assembly of the rotary type twin compressor according to the present invention, when seen from the top.

FIG. 6 is a view illustrating one example of the second compression assembly of the rotary type twin compressor according to the present invention, when seen from the top. As illustrated in FIG. 6, the second compression assembly 130 includes a second cylinder 131, a second eccentric portion 132, a second roller 133 and a second vane 134. As the second compression assembly 130 is identical to the first compression assembly 120 (refer to FIG. 4), detailed explanations of the components and operations thereof will be omitted. Here, the second eccentric portion 132 is eccentric to the rotation shaft 113 to have the same phase as that of the first eccentric portion 122 (refer to FIG. 5), and a vane mounting hole 134*h* on which a second vane portion 132 is mounted, a suction hole 136 communicating with the second inlet tube 152, and a discharge hole 137 communicating with the second discharge space are formed in an inside diameter of the second cylinder 131 in the positions corresponding to the vane mounting hole 124*h* (refer to FIG. 5), the suction hole 126 (refer to FIG. 5) and the discharge hole 127 (refer to FIG. 5) formed in the first cylinder 121 (refer to FIG. 5).

Figure 7:
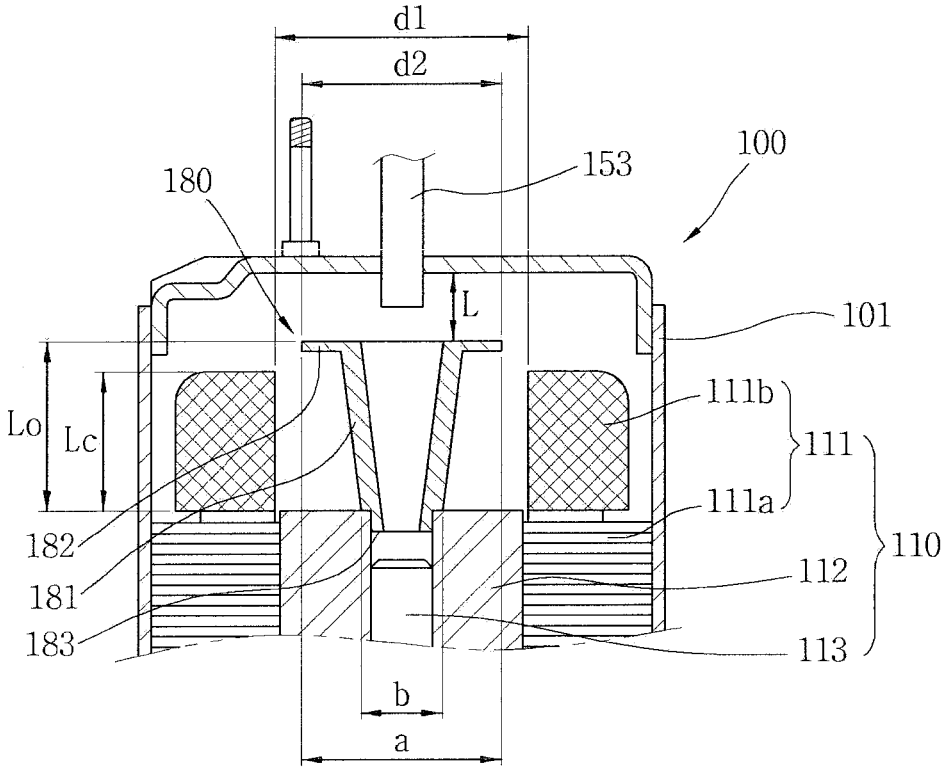
FIG. 7 is a detailed vertical-sectional view illustrating an oil recovery structure of FIG. 4.
Figure 8:
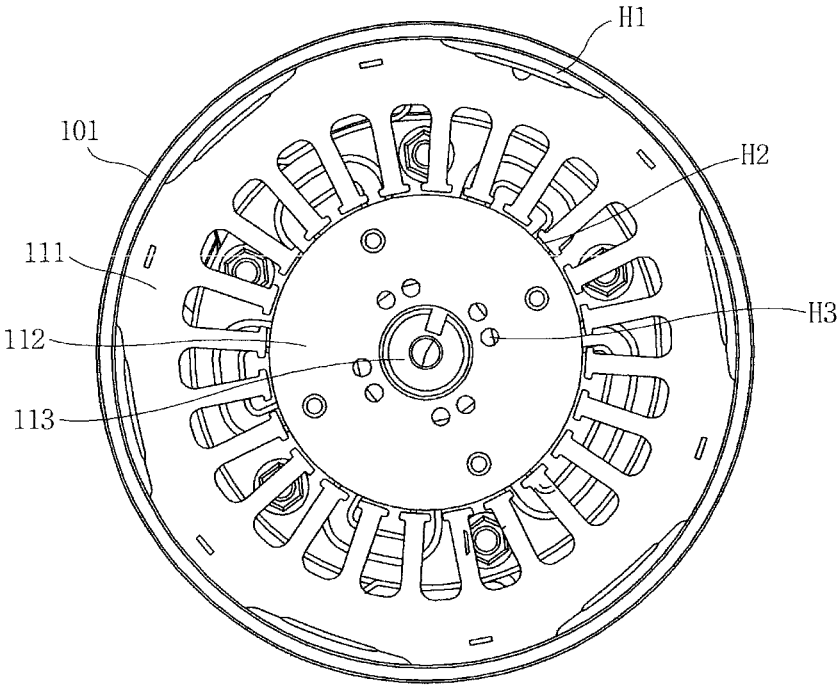
FIG. 8 is a detailed cross-sectional view illustrating the oil recovery structure of FIG. 4.

FIG. 7 is a detailed vertical-sectional view illustrating an oil recovery structure of FIG. 4, and FIG. 8 is a detailed cross-sectional view illustrating the oil recovery structure of FIG. 4.

In the rotary compressor, when the motor 110 (refer to FIG. 4) operates, the refrigerant is compressed in the first and second compression assemblies 120 and 130 (refer to FIG. 4), and the oil stored in a bottom surface of the hermetic container 101 (refer to FIG. 4) is lifted, is supplied to between the components to lubricate and cool them, runs against the oil recovery member 180, and is guided to a radius direction as shown in FIG. 7. The oil recovery member 180 includes a funnel-shaped main body 181 which can guide the rising oil flow to the radius direction, a guide portion 182 extended horizontal from a top end of the main body 181 so as to guide the oil flow to the radius direction, and a cylindrical mounting portion 183 provided at a bottom end of the main body 181 to be mounted on a top end center of the rotor 112. The mounting portion 183 of the oil recovery member 180 may be fixed to the center of the rotor 112 in various manners such as press-fitting or welding.

In addition, preferably, a height Lo of the oil recovery member 180 is higher than a height Lc of the coil end 111*b* so that the oil rising along the rotor 112 and the rotation shaft 113 can be guided to an outside diameter of the stator 111 by the oil recovery member 180. In more detail, preferably, a top end of the oil recovery member 180 is positioned higher than a top end of the coil end 111*b*. Normally, the core 111*a* of the stator 111 and the rotor 112 are installed in the same height to maximize an electromagnetic force. Since it is deemed that the coil end 111*b* exposed on the core 111*a* of the stator 111 and the oil recovery member 180 mounted on the rotor 112 are positioned in the same height, when the top end of the oil recovery member 180 is positioned higher than the top end of the coil end 111*b*, it can be deemed that the height Lo of the oil recovery member 180 is higher than the height Lc of the coil end 111*b*. Surely, numerical limitations on the relation between the height Lo of the oil recovery member 180 and the height Lc of the coil end 111*b* will be explained later in detail. Here, although the height Lo of the oil recovery member 180 is higher than the height Lc of the coil end 111*b*, it is not preferable that the oil recovery member 180 is brought into contact with the hermetic container 101. In order to secure a minimum space for withdrawing an electric wire from the coil end 111*b* to the hermetic container 101, preferably, an interval L between the oil recovery member 180 and the hermetic container 101 is maintained over a set height.

Moreover, preferably, a ratio (d1/d2) of a top end diameter d1 of the oil recovery member 180 to an inside diameter d2 of the coil end 111*b* is determined within a set range so that the oil rising along the rotor 112 and the rotation shaft 113 can be spread in the radius direction through the space between the coil end 111*b* and the oil recovery member 180. That is, when the ratio (d1/d2) of the top end diameter d1 of the oil recovery member 180 to the inside diameter d2 of the coil end 111*b* is excessively small, the oil spreading effect of the oil recovery member 180 is reduced, and when the ratio (d1/d2) of the top end diameter d1 of the oil recovery member 180 to the inside diameter d2 of the coil end 111*b* is excessively large, the oil recovery member 180 operates as a resistance to the oil flow. Therefore, numerical limitations on the ratio (d1/d2) of the top end diameter d1 of the oil recovery member 180 to the inside diameter d2 of the coil end 111*b* will be described below in detail, considering the oil spreading effect and the oil flow resistance. Further, preferably, top and bottom end diameters a and b of the oil recovery member 180 are determined within a set range so that the oil rising along the rotor 112 and the rotation shaft 113 can be spread in the radius direction through the space between the coil end 111*b* and the oil recovery member 180. A ratio of the top end diameter a of the oil recovery member 180 to the bottom end diameter b of the oil recovery member 180, i.e., a ratio of the diameter a of the guide portion 182 to the diameter b of the mounting portion 183 is determined within a set range. That is, when the top end diameter a of the oil recovery member 180 is excessively small with respect to the bottom end diameter b of the oil recovery member 180, the oil spreading effect of the oil recovery member 180 is reduced, and when the top end diameter a of the oil recovery member 180 is excessively large with respect to the bottom end diameter b of the oil recovery member 180, a flow direction of the oil rising along the rotor 112 and the rotation shaft 113 is excessively changed by the oil recovery member 180, so that the oil recovery member 180 operates as a resistance to the oil flow. Accordingly, numerical limitations on the ratio of the top end diameter a of the oil recovery member 180 to the bottom end diameter b of the oil recovery member 180 will be described below in detail, considering the oil spreading effect and the oil flow resistance. Surely, the height Lo of the oil recovery member 180 is set higher than the height Lc of the coil end 111*b*. Since the height Lo of the oil recovery member 180 is determined considering the shape of the oil recovery member 180 and the minimum space for withdrawing the electric wire from the coil end 111*b* to the hermetic container 101, when the top end diameter a of the oil recovery member 180 is varied with respect to the bottom end diameter b of the oil recovery member 180, the height Lo of the oil recovery member 180 may be varied.

As described above, since the coil end 111*b* is provided on the upper side of the core 111*a* of the stator 111, a special oil recovery hole cannot be formed in the stator 111. The oil rising along the rotor 112 and the rotation shaft 113 is guided to a radius direction by the oil recovery member 180, and recovered in the bottom surface of the hermetic container 101 through first, second and third oil recovery holes H1, H2 and H3, as shown in FIG. 8. The first oil recovery holes H1 are formed between the cylindrical hermetic container 101 and the polygonal stator 111 brought into contact therewith, and the number thereof is six. The second oil recovery hole H2 is an annular gap formed between the stator 111 and the rotor 112 to produce a mutual electromagnetic force. The third oil recovery holes H3 are provided in the rotor 112, and the number thereof is eight. Surely, the first, second and third oil recovery holes H1, H2 and H3 may be varied in number. However, since the second and third oil recovery holes H2 and H3 are formed in the stator 111 and the rotor 112, preferably, the sizes and numbers of the second and third oil recovery holes H2 and H3 are restricted to efficiently produce the mutual electromagnetic force. Accordingly, when the sizes and numbers of the second and third oil recovery holes H2 and H3 are restricted, the oil may not be rapidly recovered through the second and third oil recovery holes H2 and H3. To solve this problem, more preferably, in addition to the second and third oil recovery holes H2 and H3, the first oil recovery holes H1 are provided in various sizes and numbers between the hermetic container 101 and the stator 111. Here, it is necessary to efficiently recover the oil in the rotary compressor wherein sectional areas of the first, second and third oil recovery holes H1, H2 and H3 are below a set ratio with respect to a cross-sectional area of the hermetic container 101. To this end, according to the present invention, as explained above, it is necessary to restrict the sizes, ratios and installation positions of the oil recovery member 180 and the coil end 111*b* to limited values.

Figure 9:
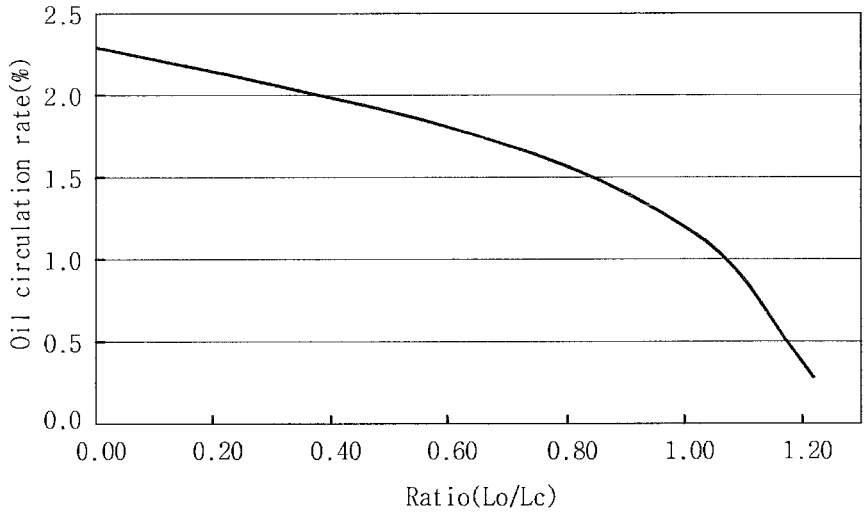
FIG. 9 is a graph showing an oil circulation rate of a freezing cycle by a ratio (Lo/Lc) of a height of an oil recovery member to a height of a coil end in a rotary compressor according to an embodiment of the present invention.

FIG. 9 is a graph showing an oil circulation rate of a freezing cycle by a ratio (Lo/Lc) of a height of an oil recovery member to a height of a coil end in a rotary compressor according to an embodiment of the present invention.

The graph shown in FIG. 9 is an experiment result of the rotary compressor wherein a hermetic container has a diameter of 112, one first oil recovery hole has an area of 7.8, a second oil recovery hole has an area of 49.33, and one third oil recovery hole has an area of 15.724. In the rotary compressor, a ratio (A2/A1) of a sectional area A2 of an oil recovery passage to a vertical-sectional area A1 of the hermetic container is 2.09%. This rotary compressor is applied to various types of freezing cycles such as refrigerators or air conditioners. The higher the ratio Lo/Lc of the height Lo of the oil recovery member to the height Lc of the coil end in the rotary compressor becomes, the lower the oil circulation rate of the freezing cycle becomes. It means that an amount of the oil discharged from the rotary compressor is reduced. More specifically, when the height Lc of the coil end is 36 and the height Lo of the oil recovery member is varied to 0, 22, 36 and 44, the ratio Lo/Lc of the height Lo of the oil recovery member to the height Lc of the coil end in the rotary compressor rises to 0, 0.61, 1.00 and 1.22. When this rotary compressor is applied to the freezing cycle, the oil circulation rate (A) of the freezing cycle falls to 2.3, 1.8, 1.2 and 0.3. Particularly, when the rotary compressor wherein the ratio Lo/Lc of the height Lo of the oil recovery member to the height Lc of the coil end is over 1 is applied, the oil circulation rate of the freezing cycle is sharply dropped. That is, since the oil recovery member is installed higher than the coil end in the rotary compressor, the oil rising along a rotation shaft and a rotor runs against the oil recovery member, and is guided to a radius direction. The oil flow is further guided to the third oil recovery holes positioned at the outermost portion as well as the first and second oil recovery holes, and recovered through the first, second and third oil recovery holes. Surely, when a rotational speed of the rotor increases, an amount of the oil pumped along the rotation shaft and the rotor also increases. Such oil runs against the oil recovery member rotating with the rotor, and is rapidly guided to and discharged through the first, second and third oil recovery holes.

Figure 10:
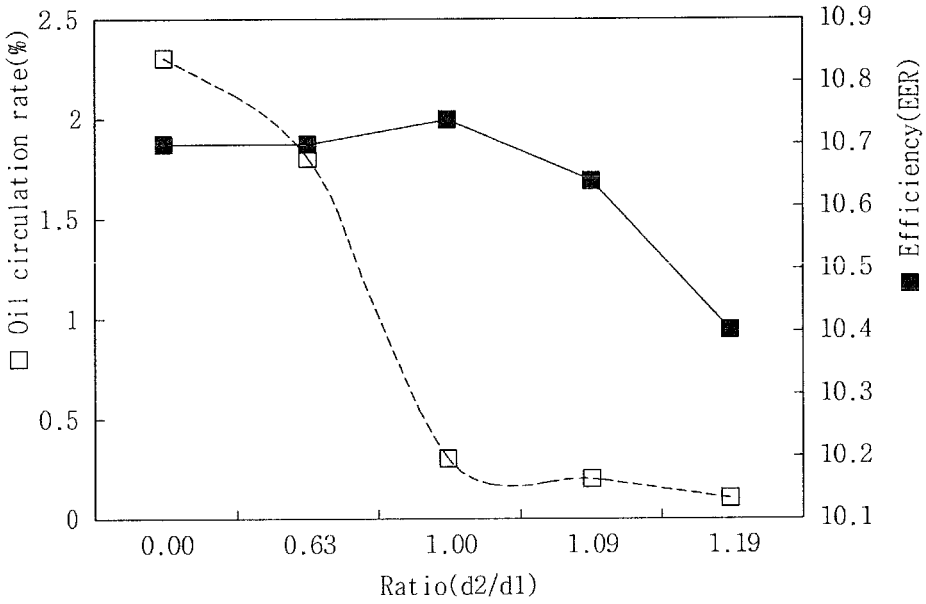
FIG. 10 is a graph showing compression efficiency by a ratio (d2/d1) of a diameter of an oil recovery member to an inside diameter of a coil end in a rotary compressor according to an embodiment of the present invention, and an oil circulation rate of a freezing cycle adopting the same.

FIG. 10 is a graph showing compression efficiency by a ratio (d2/d1) of a diameter of an oil recovery member to an inside diameter of a coil end in a rotary compressor according to an embodiment of the present invention, and an oil circulation rate of a freezing cycle adopting the same.

The graph shown in FIG. 10 is an experiment result of the rotary compressor wherein a hermetic container has a diameter of 112, one first oil recovery hole has an area of 7.8, a second oil recovery hole has an area of 49.33, and one third oil recovery hole has an area of 15.724. In the rotary compressor, a ratio (A2/A1) of a sectional area A2 of an oil recovery passage to a vertical-sectional area A1 of the hermetic container is 2.09%. This rotary compressor is applied to the freezing cycle. When the ratio (d2/d1) of the top end diameter d2 of the oil recovery member to the inside diameter d1 of the coil end in the rotary compressor increases, since the vertically-rising oil flow is spread to a radius direction to be efficiently recovered, the oil circulation rate of the freezing cycle decreases. It means that an amount of the oil discharged from the rotary compressor is reduced. Surely, when the ratio (d2/d1) of the top end diameter d2 of the oil recovery member to the inside diameter d1 of the coil end excessively increases, the oil recovery member may operate as a passage resistance disturbing the oil flow, which significantly degrades efficiency of the rotary compressor. Therefore, the ratio (d2/d1) of the top end diameter d2 of the oil recovery member to the inside diameter d1 of the coil end requires appropriate numerical limitations. More specifically, when the inside diameter d1 of the coil end is 58.9 and the top end diameter d2 of the oil recovery member is varied to 0, 36.9, 58.9, 64 and 70, the ratio (d2/d1) of the top end diameter d2 of the oil recovery member to the inside diameter d1 of the coil end in the rotary compressor rises to 0, 0.63, 1.00, 1.09 and 1.19. When this rotary compressor is applied to the freezing cycle, the oil circulation rate (%) of the freezing cycle falls to 2.3, 1.8, 0.3, 0.2 and 0.1, and efficiency (EER) of the rotary compressor rises and falls to 10.7, 10.7, 10.74, 10.64 and 10.40. Therefore, it is preferable to set the ratio (d2/d1) of the top end diameter d2 of the oil recovery member to the inside diameter d1 of the coil end to be equal to or larger than 0.63 in consideration of the oil circulation rate (%) of the freezing cycle, and to set the ratio (d2/d1) of the top end diameter d2 of the oil recovery member to the inside diameter d1 of the coil end to be equal to or smaller than 1.19 in consideration of efficiency (EER) of the rotary compressor. That is, although the oil recovery member is installed inside the coil end in the rotary compressor, when the oil recovery member more protrudes than the coil end and the ratio (d2/d1) of the top end diameter d2 of the oil recovery member to the inside diameter d1 of the coil end is appropriately adjusted to form a passage, the oil rising along the rotation shaft and the rotor runs against the oil recovery member and is guided to the radius direction. The oil flow is further guided to the third oil recovery holes positioned at the outermost portion as well as the first and second oil recovery holes, and recovered through the first, second and third oil recovery holes. Surely, when a rotational speed of the rotor increases, an amount of the oil pumped along the rotation shaft and the rotor also increases. Such oil runs against the oil recovery member rotating with the rotor, and is rapidly guided to and discharged through the first, second and third oil recovery holes.

Figure 11:
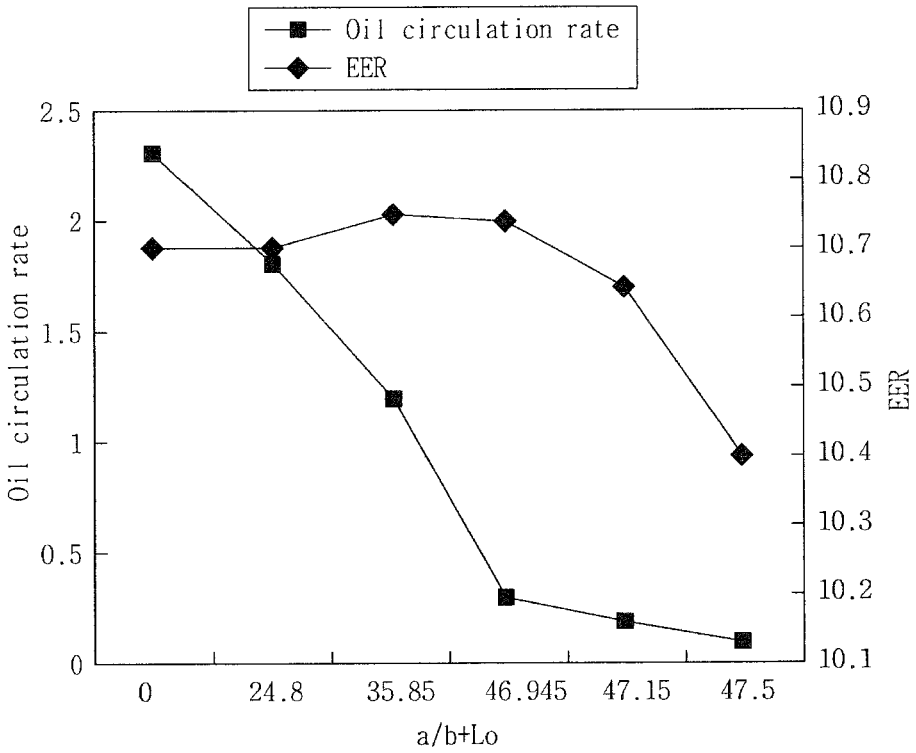
FIG. 11 is a graph showing compression efficiency by a ratio (a/b) of top and bottom end diameters of an oil recovery member in a rotary compressor according to an embodiment of the present invention, and an oil circulation rate of a freezing cycle adopting the same.

FIG. 11 is a graph showing compression efficiency by a ratio (a/b) of top and bottom end diameters of an oil recovery member in a rotary compressor according to an embodiment of the present invention, and an oil circulation rate of a freezing cycle adopting the same. The graph shown in FIG. 11 is an experiment result of the rotary compressor wherein a hermetic container has a diameter of 112, one first oil recovery hole has an area of 7.8, a second oil recovery hole has an area of 49.33, and one third oil recovery hole has an area of 15.724. In the rotary compressor, a ratio (A2/A1) of a sectional area A2 of an oil recovery passage to a vertical-sectional area A1 of the hermetic container is 2.09%. The rotary compressor with the funnel-shaped oil recovery member mounted therein is applied to various types of freezing cycles such as refrigerators or air conditioners. When the ratio (a/b) of the top end diameter a of the oil recovery member to the bottom end diameter b of the oil recovery member increases, since the vertically-rising oil flow is spread to a radius direction to be efficiently recovered, the oil circulation rate of the freezing cycle decreases. It means that an amount of the oil discharged from the rotary compressor is reduced. Surely, when the ratio (a/b) of the top end diameter a of the oil recovery member to the bottom end diameter b of the oil recovery member excessively increases, since the oil recovery member suddenly changes an oil flow direction, it may operate as a passage resistance to the oil flow, thereby significantly degrading efficiency of the rotary compressor. Therefore, the ratio (a/b) of the top end diameter a of the oil recovery member to the bottom end diameter b of the oil recovery member requires appropriate numerical limitations. More specifically, the bottom end diameter b of the oil recovery member is 20, the top end diameter a of the oil recovery member is varied to 56, 57, 58.9, 63 and 70, and a height Lo of the oil recovery member is varied to 22, 23, 44, 44, and 44. As explained above, since the height Lo of the oil recovery member is changed considering the shape of the oil recovery member and the electric wire withdrawing space, although the top and bottom end diameters a and b of the oil recovery member are changed, the height Lo of the oil recovery member cannot be set over a certain maximum value. That is, the ratio (a/b) of the top end diameter a of the oil recovery member to the bottom end diameter b of the oil recovery member in the rotary compressor is varied to 2.8, 2.85, 2.945, 3.15 and 3.5, and a value (a/b+Lo) obtained by adding the height Lo of the oil recovery member to the ratio is varied to 24.8, 35.85, 46.945, 47.15 and 47.5. When this rotary compressor is applied to the freezing cycle, the oil circulation rate (%) of the freezing cycle falls to 1.8, 1.2, 0.3, 0.2 and 0.1, and efficiency (EER) of the rotary compressor rises and falls to 10.7, 10.75, 10.74, 10.64 and 10.40. Therefore, it is preferable to set the ratio (a/b) of the top end diameter a of the oil recovery member to the bottom end diameter b of the oil recovery member to be equal to or larger than 2.85 and to set the value (a/b+Lo) obtained by adding the height Lo, of the oil recovery member to the ratio to be equal to or larger than 35.85 in consideration of the oil circulation rate (%) of the freezing cycle. Moreover, it is preferable to set the ratio (a/b) of the top end diameter a of the oil recovery member to the bottom end diameter b of the oil recovery member to be equal to or smaller than 3.5 and to set the value (a/b+Lo) obtained by adding the height Lo of the oil recovery member to the ratio to be equal to or smaller than 47.5 in consideration of efficiency (EER) of the rotary compressor. That is, although the oil recovery member is installed inside the coil end in the rotary compressor, when the oil recovery member more protrudes than the coil end and the top and bottom end diameters a and b and the height Lo of the oil recovery member are appropriately adjusted to form a passage, the oil rising along the rotation shaft and the rotor runs against the oil recovery member and is guided to the radius direction. The oil flow is further guided to the third oil recovery holes positioned at the outermost portion as well as the first and second oil recovery holes, and recovered through the first, second and third oil recovery holes. Surely, when a rotational speed of the rotor increases, an amount of the oil pumped along the rotation shaft and the rotor also increases. Such oil runs against the oil recovery member rotating with the rotor, and is rapidly guided to and discharged through the first, second and third oil recovery holes. Although the rotary compressor and the motor mechanism applied thereto have been described in detail in connection with the embodiments and the accompanying drawings of the present invention, the present invention can be applied to various types of motors, various types of compressors adopting the motors, and various types of freezing cycles adopting the compressors. However, the scope of the present invention is not limited to the embodiments and drawings, but is defined by the appended claims.

The invention claimed is:

1. An oil recovery member configured to be coupled to a center of a rotor, the rotor being engaged with an outer circumferential surface of a rotational shaft, the rotational shaft having a bottom end configured to be positioned in oil, such that, when the rotor is operated, the oil rises along the rotor in an axial direction, flows along an outer surface of the oil recovery member and is guided in a radial direction, the oil recovery member comprising:

a main body having a funnel shape with a diameter that increases from a lower portion to an upper portion in an axial direction of the main body;

a guide portion that extends from a top end of the main body in a a radial direction of the main body; and a mounting portion provided at a bottom end of the main body to be mounted on a top end center of the rotor, wherein a ratio of a diameter (a) of the guide portion to an outer diameter (b) of the bottom end of the main body is maintained to be equal to or larger than 2.85 ($a/b \geq 2.85$) and to be equal to or smaller than 3.15 ($a/b \leq 3.15$).

2. A motor mechanism, comprising:

a rotational shaft having a bottom end configured to be positioned in oil;

a rotor engaged with an outer circumferential surface of the rotational shaft;

a stator installed to maintain a gap from an outer circumferential surface of the rotor, and provided with a coil end at an upper portion of the stator, a coil being wound around a core to form the stator; and an oil recovery member coupled to a center of the rotor, wherein the oil recovery member includes a main body having a funnel-shape with a diameter that increases from a lower portion to an upper portion in an axial direction of the main body, and a guide portion that extends from a top end of the main body in a radial direction of the main body, and wherein, when the motor mechanism is operated, the oil rises along the rotor in an axial direction of the rotor, flows along an outer surface of the oil recovery member, and is guided in the radial direction, wherein the guide portion of the oil recovery member has a height (Lo) higher than a height (Lc) of the coil end, in the axial direction, so as to guide the oil to flow against the outer surface of the oil recovery member over the coil end and outside of the coil end.

3. The motor mechanism of claim 2, wherein a ratio (d2/d1) of a top end diameter (d2) of the oil recovery member to an inside diameter (d1) of the coil end is maintained to be equal to or larger than 0.63 so as to improve an oil recovery rate.

4. The motor mechanism of claim 3, wherein the ratio (d2/d1) of the top end diameter (d2) of the oil recovery member to the inside diameter (d1) of the coil end is maintained to be equal to or smaller than 1.19 so as to reduce a passage resistance.

5. The motor mechanism of claim 4, wherein the top end diameter (d2) of the oil recovery member is equal to a diameter of the guide portion.

6. The motor mechanism of claim 2, wherein a ratio of diameter (a) of the guide portion to an outer diameter (b) of the bottom end of the main body is maintained to be equal to or larger than 2.85 so as to improve an oil recovery rate ($a/b \geq 2.85$).

7. The motor mechanism of claim 2, wherein a ratio of a diameter (a) of the guide portion to an outer diameter (b) of the bottom end of the main body is maintained to be equal to or smaller than 3.15 so as to reduce a passage resistance ($a/b \leq 3.15$).

8. A compressor, comprising:

a hermetic container into and from which refrigerant is sucked and discharged, oil being stored in a bottom surface of the hermetic container;

a compression mechanism fixed to an inner lower portion of the hermetic container, that compresses a refrigerant;

a motor mechanism fixed to an inner upper portion of the hermetic container, that supplies power to the compression mechanism; and an oil recovery member coupled to a center of the motor mechanism wherein the oil recovery member includes a main body having a funnel-shape with a diameter that increases from a lower portion to an upper portion in an axial direction of the main body, and a guide portion that extends from a top end of the main body in a radial direction of the main body, wherein, when the motor mechanism is operated, the oil rises along the motor mechanism in the axial direction, flows along an outer surface of the oil recovery member, and is guided in the radial direction, and wherein a top end of the oil recovery member is installed higher than a top end of the motor mechanism in the axial direction.

9. The compressor of claim 8, wherein the motor mechanism comprises a rotational shaft, a rotor, and a stator provided with a coil end at an upper portion of the stator, a coil being wound around a core to form the stator, and the oil recovery member is coupled to a center of the rotor so that a height (Lo) of the oil recovery member is greater than or equal to a height (Lc) of the coil end ($Lo \geq Lc$), in the axial direction.

10. The compressor of claim 8, wherein the motor mechanism comprises a rotational shaft, a rotor, and a stator provided with a coil end at an upper portion of the stator, a coil being wound around a core to form the stator, and a height (Lo) of the oil recovery member is equal to or smaller than a value obtained by adding an axial direction height (L) of an electric wire withdrawal space to an axial direction height (Lc) of the coil end ($Lo \leq Lc+L$).

11. The compressor of claim 10, wherein the electric wire withdrawal space is a minimum space required to withdraw an electric wire from the coil end to the hermetic container.

12. The compressor of claim 8, further comprising a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 3%.

13. The compressor of claim 12, wherein the oil recovery holes comprise a plurality of first oil recovery holes provided between the hermetic container and the stator, a second oil recovery hole which is a gap between the rotor and the stator, and a plurality of third oil recovery holes provided in the rotor.

14. The compressor of claim 8, wherein the motor mechanism comprises a rotational shaft connected to the compression mechanism, a cylindrical rotor engaged with an outer circumferential surface of the rotational shaft, and a cylindrical stator fixed to the hermetic container to maintain a gap from an outer circumferential surface of the rotor, and provided with a coil end at an upper portion of the stator, a coil being wound around a core to form the stator, wherein a ratio (d2/d1) of a top end diameter (d2) of the oil recovery member to an inside diameter (d1) of the coil end is maintained to be equal to or larger than 0.63 so as to improve an oil recovery rate.

15. The compressor of claim 14, wherein the ratio (d2/d1) of the top end diameter (d2) of the oil recovery member to the inside diameter (d1) of the coil end is maintained to be equal to or smaller than 1.19 so as to reduce a passage resistance.

16. The compressor of claim 15, wherein the top end diameter (d2) of the oil recovery member is equal to a diameter of the guide portion.

17. The compressor of claim 14, further comprising a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 3.0%.

18. The compressor of claim 17, wherein the oil recovery holes comprise a plurality of first oil recovery holes provided between the hermetic container and the stator, a second oil recovery hole which is a gap between the rotor and the stator, and a plurality of third oil recovery holes provided in the rotor.

19. The compressor of claim 8, wherein a ratio of a top end diameter (a) of the oil recovery member to a bottom end diameter (b) of the oil recovery member is maintained to be equal to or larger than 2.85 so as to improve an oil recovery rate ($a/b \geq 2.85$).

20. The compressor of claim 19, wherein the ratio of the top end diameter (a) of the oil recovery member to the bottom end diameter (b) of the oil recovery member is maintained to be equal to or smaller than 3.15 so as to reduce a passage resistance ($a/b \leq 3.15$).

21. The compressor of claim 19, wherein the top end diameter (a) of the oil recovery member is a diameter of the guide portion, and the bottom end diameter (b) of the oil recovery member is a diameter of the lower portion of the main body.

22. The compressor of claim 19, further comprising a plurality of oil recovery holes for use in recovering the oil running against the oil recovery member to a lower portion of the hermetic container, wherein a ratio (A2/A1) of sectional areas (A2) of the oil recovery holes to a sectional area (A1) of the hermetic container is equal to or smaller than 3%.

23. The compressor of claim 22, wherein the motor mechanism comprises a stator fixed to an inside surface of the hermetic container, and a rotor rotatably installed inside the stator, and wherein the oil recovery holes comprise a plurality of first oil recovery holes provided between the hermetic container and the stator, a second oil recovery hole which is a gap between the rotor and the stator, and a plurality of third oil recovery holes provided in the rotor.

* * * * *